US008505899B2

(12) United States Patent
Kawatsu et al.

(10) Patent No.: US 8,505,899 B2
(45) Date of Patent: Aug. 13, 2013

(54) SHEET FOLDING DEVICE AND SHEET POST-PROCESSING DEVICE USING SAME

(75) Inventors: Kenji Kawatsu, Toyohashi (JP); Hisao Hosoya, Sagamihara (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/100,921

(22) Filed: May 4, 2011

(65) Prior Publication Data

US 2011/0281709 A1 Nov. 17, 2011

(30) Foreign Application Priority Data

May 11, 2010 (JP) ..... 2010-109503

(51) Int. Cl.
*B41L 43/06* (2006.01)

(52) U.S. Cl.
USPC .... 270/39.01; 270/32; 270/39.06; 270/39.07; 270/39.08

(58) Field of Classification Search
USPC ..... 270/32, 39.01, 39.06, 39.07, 39.08; 493/419, 420, 421, 424, 429, 442
See application file for complete search history.

(56) References Cited

U.S. PATENT DOCUMENTS

| | | | | |
|---|---|---|---|---|
| 7,111,837 | B2 * | 9/2006 | Itou et al. | 270/45 |
| 7,850,155 | B2 | 12/2010 | Mizubata et al. | |
| 2002/0086786 | A1 | 7/2002 | Kamizuru et al. | |
| 2003/0123894 | A1 | 7/2003 | Ueda et al. | |
| 2009/0189326 | A1 * | 7/2009 | Mizubata et al. | 270/20.1 |

FOREIGN PATENT DOCUMENTS

| | | | |
|---|---|---|---|
| JP | 2002-193544 | A | 7/2002 |
| JP | 2003-252522 | A | 9/2003 |
| JP | 2006-213473 | A | 8/2006 |
| JP | 2009-173430 | A | 8/2009 |
| JP | 2010-006566 | A | 1/2010 |
| JP | 2010-100347 | A | 5/2010 |
| JP | 2010-163219 | A | 7/2010 |

OTHER PUBLICATIONS

Japanese Notice of Allowance dated May 22, 2012 issued in the corresponding Japanese Patent Application No. 2010-109503 and English language translation.

* cited by examiner

*Primary Examiner* — Leslie A Nicholson, III
(74) *Attorney, Agent, or Firm* — Buchanan Ingersoll & Rooney PC

(57) ABSTRACT

Sheet pressing means (59) is provided that assists the formation of a bend in a sheet (S) and that guides the bend in the sheet (S) into the nip portion between a second roller (54) and a third roller (55). The sheet pressing means (59) is formed with a cylindrical sheet member (591) and a bar-shaped member (592) that is inserted into the cylindrical sheet member (591). The top portion of the sheet member (591) is attached to a base member (593), and thus the bar-shaped member (592) is supported by the sheet member (591) such that the longitudinal direction of the bar-shaped member (592) is held substantially in a horizontal state. Thus, it is possible to perform processing for reliably folding the sheet in a predetermined position regardless of the material quality, the thickness and the like of the sheet; even if a strong force is applied to the sheet pressing means at the time of processing for handing a paper jam or the like, the sheet pressing means is unlikely to be deformed; and it is possible to stably perform the folding processing for a long period of time.

18 Claims, 5 Drawing Sheets

SHEET FOLDING DEVICE AND SHEET POST-PROCESSING DEVICE USING SAME

This application is based on Japanese Patent Application No. 2010-109503 filed on May 11, 2010, the contents of which are hereby incorporated by reference.

BACKGROUND OF THE INVENTION

1. Field of the Invention

The present invention relates to a sheet folding device and a sheet post-processing device using such a sheet folding device. More particularly, the present invention relates to a sheet folding device that can perform, for example, processing for folding a sheet of paper double or in three and to a sheet post-processing device using such a sheet folding device.

2. Description of the Related Art

Conventionally, there is known a sheet folding device that can perform processing for folding a sheet of paper double or in three; for example, the sheet folding device is used as a post-processing device of an image forming device such as a copying machine or a printer by being combined with the image forming device. This post-processing device performs, for example, processing for folding a sheet ejected from the image forming device double in a predetermined center position and then ejects the sheet, and thus it is unnecessary to fold the sheet after an image is formed, with the result that it is possible to reduce time and labor.

For example, in Japanese Unexamined Patent Application Publication No. 2006-213473, there is disclosed a sheet post-processing device which includes a first folding roller pair for forming a first crease in a sheet member and a second folding roller pair for forming a second crease, which presses a leading edge of the sheet member in a transport direction against a first press-reception member to form a bend in the sheet member, which guides the formed bend between the nips of the first folding roller pair to form the first crease, which then presses the formed first crease against a second press-reception member to form a bend in the sheet member, which guides the formed bend between the nips of the second folding roller pair to form the second crease and in which the first press-reception member and the second press-reception member move freely in the transport direction.

However, in a method of regulating a bend in a sheet member with the shape of a transport path to control the position of the crease of the sheet member, there is a possibility that the crease is not properly formed in a predetermined position depending on the material quality and thickness of the sheet member, the state of curling or the like. When the bend in the sheet member is strictly regulated with the transport path, the capability of transporting the sheet member is reduced, and a failure in which, for example, the sheet member is jammed is disadvantageously encountered.

The present invention is made in view of such a problem in the sheet folding device; an object of the present invention is to provide a sheet folding device and a sheet post-processing device that can perform processing for reliably folding a sheet in a predetermined position regardless of the material quality, the thickness and the like of the sheet member.

SUMMARY OF THE INVENTION

According to the present invention, there is provided a sheet folding device including: a first folding roller pair that forms a first crease in a sheet; a second folding roller pair that forms a second crease in the sheet; a first stopper member that a leading edge of the sheet transported in a transport direction is pressed against and that places the sheet into position; and a second stopper member that the first crease in the sheet is pressed against and that places the sheet into position, in which the leading edge of the sheet in the transport direction is pressed against the first stopper member such that a position where the first crease in the sheet is to be formed is determined, the position where the first crease is to be formed is guided into a nip portion of the first folding roller pair such that the first crease is formed in the sheet, then the first crease in the sheet is pressed against the second stopper member such that a bend is formed in the sheet and the formed bend is guided into a nip portion of the second folding roller pair such that the second crease is formed in the sheet. The sheet folding device further includes a sheet pressing unit that assists the formation of the bend in the sheet and that guides the bend into the nip portion of the second folding roller pair, in which the sheet pressing unit includes a pressing member whose weight assists the formation of the bend in the sheet and a flexible support member that swingably supports the pressing member.

At least a part of the pressing member is preferably rigid and/or elastic.

Preferably, in order to further enhance the durability or the like of the sheet pressing unit, the sheet pressing unit uses a bar-shaped member as the pressing member and a cylindrical sheet member as the support member, and the sheet pressing unit is formed by inserting into a sheet member the bar-shaped member whose circumferential length is less than the circumferential length of the sheet member.

Preferably, the first folding roller pair is formed with a first roller and a second roller, and the second folding roller pair is formed with the second roller and a third roller.

Preferably, in order to accurately form the first crease in the sheet, a sheet folding unit is further provided that pushes out the position where the first crease is to be formed from the side of a surface of the sheet opposite a surface with respect to the first folding roller pair toward the nip portion of the first folding roller.

Preferably, when the sheet does not pass, a free end of the sheet pressing unit is arranged on the side of the nip portion with respect to a common tangent of the second folding roller pair on the upstream side in the transport direction.

According to the present invention, there is provided a sheet post-processing device including the sheet folding device described above.

DESCRIPTION OF PREFERRED EMBODIMENTS

A sheet folding device and a sheet post-processing device according to the present invention will be described in further detail below with reference to the accompanying drawings; the present invention is not limited to an embodiment that will be described below.

Figure 1:
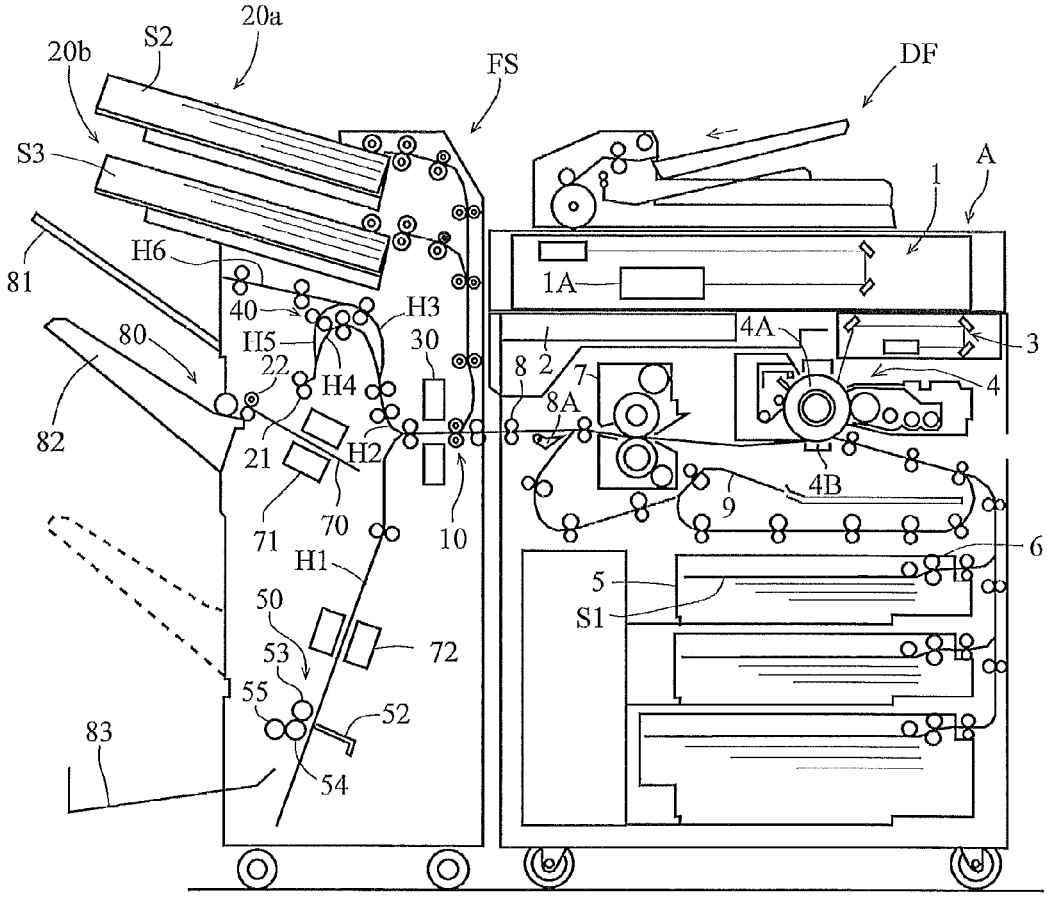
[FIG. 1] An overall diagram showing an example of a sheet post-processing device and an image forming device that incorporate a sheet folding device according to the present invention.

FIG. 1 shows a schematic diagram showing an example of an image forming device A and a sheet post-processing device FS. The image forming device A includes an image reading portion 1, an image processing portion 2, an image writing portion 3, an image formation portion 4, a paper feed cassette 5, paper feed means 6, a fixing device 7, a paper ejection portion 8 and an automatic double-sided copy paper feed unit (ADU) 9. An automatic original document feed device DF is mounted on the top of the image forming device A; the sheet post-processing device FS is coupled to the side portion of the image forming device A on the side of the paper ejection portion 8.

An original document placed on the document rack of the automatic original document feed device DF is transported in the direction indicated by an arrow, and an image on one side of or images on both sides of the original document are read by the optical system of the image reading portion 1 and are read into a CCD image sensor 1A. An analog signal that is photoelectrically converted by the CCD image sensor 1A is subjected to analog processing, A-D conversion, shading correction, image compression processing and the like in the image processing portion 2 and is then fed to the image writing portion 3.

In the image formation portion 4, processing such as charging, exposure, development, transfer, separation and cleaning is performed. Specifically, the surface of a photoconductor drum 4A is evenly charged by charging means, then semiconductor laser light is applied from the image writing portion 3 to the photoconductor drum 4A based on image data and an electrostatic latent image is formed on the surface of the photoconductor drum 4A. Then, toner is supplied to the electrostatic latent image by development means to change it into a visual image, and thereafter the toner image is transferred by transfer means 4B to a sheet S1 fed by the paper feed means 6 from the paper feed cassette 5. The sheet Si to which the toner image has been transferred is heated and pressed by the fixing device 7, thus the toner image is fixed to the sheet S1, and the sheet S1 is fed from the paper ejection portion 8 to the sheet post-processing device FS.

When images are formed on both sides of the sheet S1, the sheet S1 in which an image has been formed on one side of the sheet is transported by a transport switch plate 8A to the ADU 9, the toner image is transferred again by the image formation portion 4 to the back side and is fixed, and then the sheet S1 is ejected from the paper ejection portion 8.

The sheet post-processing device FS, which is coupled to the image forming device A, includes a sheet reception portion 10, insertion paper feed portions 20*a* and 20*b*, a drilling processing portion 30, a stacking processing portion 40, a folding processing portion 50, binding processing portions 71 and 72 and a paper ejection portion 80.

Insertion paper S2 is placed in the insertion paper feed portion 20*a*, and the other insertion paper S3 is placed in the insertion paper feed portion 20*b*. The insertion paper S2 and S3 is insertion paper, such as a cover sheet or an insert sheet, that is inserted into the sheets Si ejected from the image forming device A; as with the sheet S1, the insertion paper S2 and S3 is subjected to the drilling processing and the folding processing. The insertion paper S2 and S3 fed out from the insertion paper feed portions 20*a* and 20*b* is transported through a transport path (with no reference numeral) moving downward to the sheet reception portion 10. In the following description, the sheet S1 and the insertion paper S2 and S3 are also collectively referred to as a sheet S.

In the sheet reception portion 10, the drilling processing portion 30 is arranged that drills holes in predetermined positions of the sheet S. The folding processing portion 50 is arranged on a transport path H1 that branches downward from the sheet reception portion 10; the stacking processing portion 40 is arranged on the downstream side in a sheet transport direction of a transport path H2 that branches upward from the sheet reception portion 10 and is provided with an inside transport path H4 and an outside transport path H3 which are branched and doubly curved.

The stacking processing portion 40 places the subsequent sheet S on standby on the transport path H3 and the transport paths H4 and H5 so that the binding processing portion 71 arranged on the downstream side in the sheet transport direction obtains a time for performing the binding processing on the preceding sheet S. Specifically, transport rollers 21 are provided in the ejection port of the transport path H4, and, when the first one of the sheets S on which to perform the binding processing is transported, the rotation of the transport rollers 21 is stopped, and thus the sheet is received and placed on standby with a leading edge of the sheet in contact with the transport rollers 21. On the other hand, the subsequent sheet S is transported from the transport path H2 to the transport paths H3 and H5 to reach the transport rollers 21. With the preceding sheet S and the subsequent sheet S stacked, those two sheets are transported together from the transport rollers 21 to a collection portion 70.

The transport path H3 branches into the transport path H5 and a transport path H6, and the transport path H6 serves as a paper ejection path that leads to a paper ejection tray 81.

The paper ejection portion 80 has a paper ejection roller pair 22 and a justification mechanism. When the paper is not ejected, the paper ejection roller pair 22 is separated whereas when the paper is ejected, the paper ejection roller pair 22 comes in contact to nip and transport the sheet S and ejects the sheet S into an up-and-down tray 82. Although the justification mechanism is not shown, it reciprocates in vertical and horizontal directions with respect to the direction in which the sheets are ejected so as to justify the sheets in the width direction; a conventionally known mechanism is used as the justification mechanism.

Although the sheet S transported by the transport rollers 21 is transported toward the paper ejection roller pair 22, since, as described above, the paper ejection roller pair 22 is separated when the paper is not ejected, the sheet S is dropped to the collection portion 70 when the rear end of the sheet S separates from the transport rollers 21, then slips down on the inclined collection portion 70 and is received by a stopper (not shown), with the result that the sheet S is collected in the collection portion 70.

When a set number of sheets S are collected in the collection portion 70, the binding processing portion 71 is operated to perform the binding processing on the sheets S. The sheets S on which the binding processing has been performed are pushed up by the stopper, and are moved on the collection portion 70 toward the paper ejection roller pair 22 (the upper left side of the FIGure). Here, the paper ejection roller pair 22 is pressed to nip and eject the sheets S into the up-and-down tray 82.

A folding mode and a center binding mode of the sheet S will now be described. In the folding mode, the sheet S is transported downward on the transport path H1 from the sheet reception portion 10, is subjected to processing for folding the sheet S double in the center position or processing for folding the sheet S in three by the folding processing portion 50 and is ejected into a lower paper ejection tray 83. On the other hand, in the center binding mode, the sheet S is transported on the transport path H1 from the sheet reception portion 10, is subjected to center binding processing by a center binding processing portion 72, is then subjected to the processing for folding the sheet S double in the center position by the folding processing portion 50 and is ejected into the lower paper ejection tray 83.

As described above, the following four paths are present as the paths through which the sheet S is ejected.

(a) sheet reception portion 10→transport path H2→transport path→transport path H6→paper ejection tray 81

(b) sheet reception portion 10→transport path H2→transport paths H3, H4 and H5→collection portion 70→paper ejection portion 80→up-and-down tray 82

(c) sheet reception portion 10→transport path H2→transport path H4→paper ejection portion 80→up-and-down tray 82

(d) sheet reception portion 10→transport path H1→folding processing portion 50→lower paper ejection tray 83

The sheet ejection path (c) is a sheet ejection path that is selected when a large amount of image formation is performed without the binding processing and the folding processing being performed. The up-and-down tray 82 is moved downward as indicated by broken lines such that the uppermost surface of the sheets S ejected always has a constant height. Thus, several thousands of sheets can be collected in the up-and-down tray 82.

Figure 2:
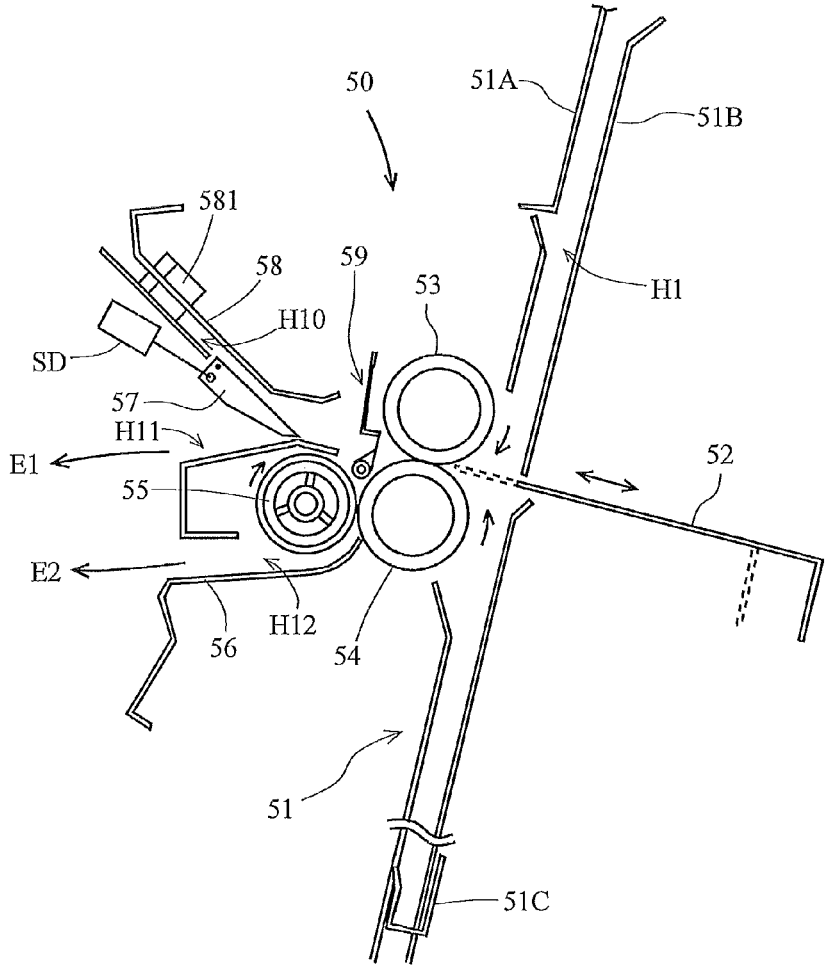
[FIG. 2] A schematic diagram showing an example of the a sheet folding device according to the present invention.

FIG. 2 shows a schematic diagram of the folding processing portion 50. The folding processing portion 50 includes a first stopper 51C, a sheet folding plate (sheet folding means) 52, a first roller 53, a second roller 54, a third roller 55, a transport path switch member 57, a guide plate 58, a second stopper 581 and sheet pressing means 59; the folding processing portion 50 performs processing for folding the sheet S double or in three. In the present embodiment, the first roller 53 and the second roller 54 constitute a first folding roller pair, and the second roller 54 and the third roller 55 constitute a second folding roller pair. In other words, the second roller 54 is used both in the first folding roller pair and in the second folding roller pair. Thus, it is possible to reduce the number of components and also reduce the size and weight of the device. Needless to say, the first folding roller pair and the second folding roller pair may be each composed of different rollers.

The transport path H1 is composed of a guide plate 51A and a guide plate 51B; on the downstream side of the transport path H1 in the sheet transport direction, the first stopper 51C is provided that regulates the position of the sheet S. The leading edge of the sheet S in the sheet transport direction is pressed against the first stopper 51C, and thus the first stopper 51C specifies the position of a first crease. The first stopper 51C moves either in the sheet transport direction or in the opposite direction according to the size of the sheet and the position where the first crease is formed.

The sheet folding plate 52 is arranged in a position opposite a nip portion between the first roller 53 and the second roller 54 through the transport path H1 such that the sheet folding plate 52 is retractable with respect to the transport path H1. The sheet folding plate 52 is generally retracted with respect to the transport path H1, and hence the movement of the sheet S transported on the transport path H1 is not prevented by the sheet folding plate 52. Then, when the first crease is formed in a predetermined position of the sheet S whose position is regulated by the first stopper 51C, the sheet folding plate 52 is protruded toward the nip portion between the first roller 53 and the second roller 54 by an unillustrated drive source. In this way, the predetermined position of the sheet S is guided to the nip portion between the first roller 53 and the second roller 54, and thus the first crease is formed in the sheet S.

The first roller 53 and the second roller 54 constituting the first folding roller pair are pressed against each other by unillustrated force application means; at least one of the rollers is driven and rotated in a direction indicated by the arrow of the FIGure. The outer circumferential surfaces of the first roller 53 and the second roller 54 have a high frictional resistance.

The transport path switch member 57 is provided such that the transport path switch member 57 can be swung by a solenoid SD. When the processing for folding the sheet S in three is performed, the transport path switch member 57 is placed in a position indicated by a solid line and guides the sheet S onto a transport path H10 formed with the guide plate 58. On the other hand, when the sheet S is folded double, that is, is folded double in the center position or is subjected to center binding/center folding processing, the transport path switch member 57 swings in the counterclockwise direction of the FIGure and thereby guides the sheet S onto a transport path H11 and transports it to an ejection port E1.

The transport path H10 is formed to intersect a straight line perpendicular to a straight light intersecting the rotation centers of the first roller 53 and the second roller 54. Thus, a bend is formed in the sheet S transported by the transport path H10. The transport path H10 is provided with the second stopper 581. The first crease of the sheet S is pressed against the second stopper 581, and thus the bend is formed in the sheet S; the second stopper 581 moves either in the sheet transport direction or in the opposite direction according to the position where a second crease is formed.

The second roller 54 and the third roller 55 constituting the second folding roller pair are pressed against each other by unillustrated force application means; at least one of the rollers is driven and rotated in a direction indicated by the arrow of the FIGure. The outer circumferential surfaces of the second roller 54 and the third roller 55 have a high frictional resistance.

Figure 3:
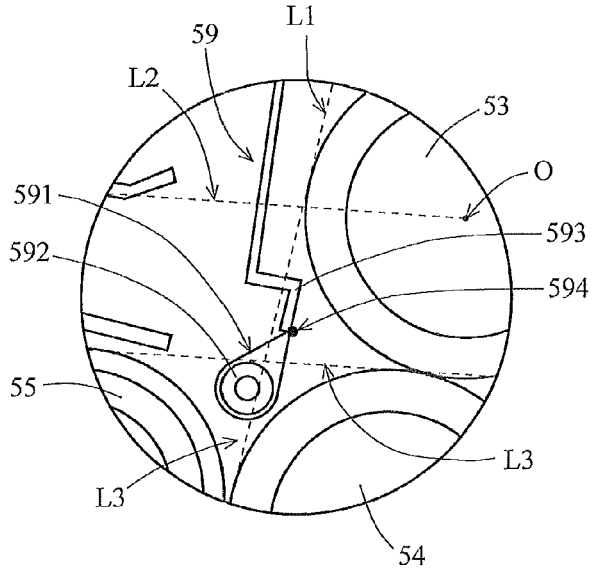
[FIG. 3] An enlarged view of a portion of sheet pressing means of FIG. 2 and its vicinity.

The sheet pressing means 59 is provided on the downstream side in the sheet transport direction of the nip portion between the first roller 53 and the second roller 54 and on the upstream side in the sheet transport direction of the nip portion between the second roller 54 and the third roller 55. FIG. 3 is an enlarged view of the sheet pressing means 59 and its vicinity. The sheet pressing means 59 includes a cylindrical sheet member 591 that serves as a support member and a bar-shaped member 592 that serves as a pressing member; the bar-shaped member 592 is inserted into the cylindrical sheet member 591. The top portion of the sheet member 591 is attached to a base member 593. The circumferential length of the bar-shaped member 592 is less than that of the sheet member 591; the bar-shaped member 592 is supported by the sheet member 591 such that the longitudinal direction of the bar-shaped member 592 is held substantially in a horizontal state. Thus, the bar-shaped member 592 and the sheet member 591 freely swing on a pivot point 594 where they are attached to the base member 593. The sheet pressing means 59 may be formed as a member that extends long in an axis direction; a plurality of sheet pressing means 59 may be provided in the axis direction. The bar-shaped member 592 and the sheet member 591 are preferably fixed to each other.

The material of the sheet member 591 is not particularly limited as long as the material is flexible; a resin sheet formed of polyethylene terephthalate (PET) or the like is suitably used.

Although the bar-shaped member 592 can be formed of a conventionally known material such as resin, rubber or metal, at least a part thereof is preferably rigid and/or elastic. When the sheet pressing means 59 assists the formation of the bend in the sheet S with its weight alone, the material of the bar-shaped member 592 is preferably determined as appropriate in consideration of the weight of the bar-shaped member 592, the type and thickness of the sheet S on which the folding processing is performed and the like. The shape of the pressing member is not limited to the shape of a bar; for example, the pressing member may be formed in the shape of a sphere or the like.

Preferably, in order for the effect of assisting the formation of the bend in the sheet S with the sheet pressing means 59 to be obtained, as shown in FIG. 3, the pivot point 594 of the sheet pressing means 59 is arranged on the side of the nip portion between the first roller 53 and the second roller 54 with respect to a common tangent L1 of the first roller 53 and the second roller 54 on the downstream side in the sheet transport direction, and is also arranged to be lower than a line L2 that is parallel to a common tangent of the second roller 54 and the third roller 55 on the upstream side in the sheet transport direction and that passes through the center O of the first roller 53.

The end of the sheet pressing means 59 in a normal state where the sheet is not transported is preferably arranged on the side of the nip portion between the second roller 54 and the third roller 55 with respect to a common tangent L3 of the second roller 54 and the third roller 55 on the upstream side in the sheet transport direction. Furthermore, the end of the sheet pressing means 59 preferably does not come in contact with both the second roller 54 and the third roller 55.

Figure 4A:
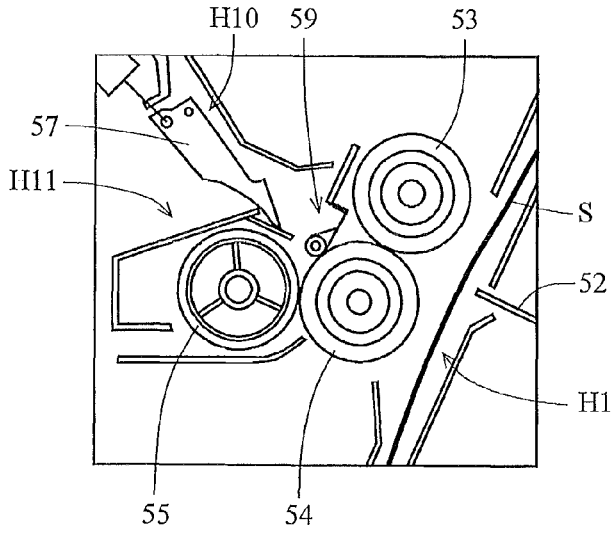
[FIG. 4] A process diagram of how a sheet is folded double.
Figure 4B:
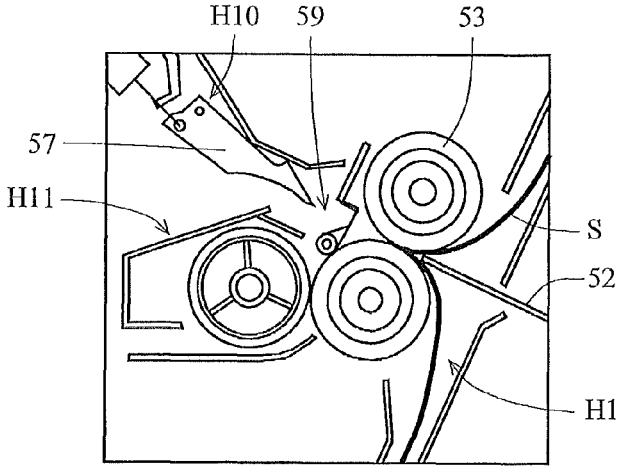
Figure 4C:
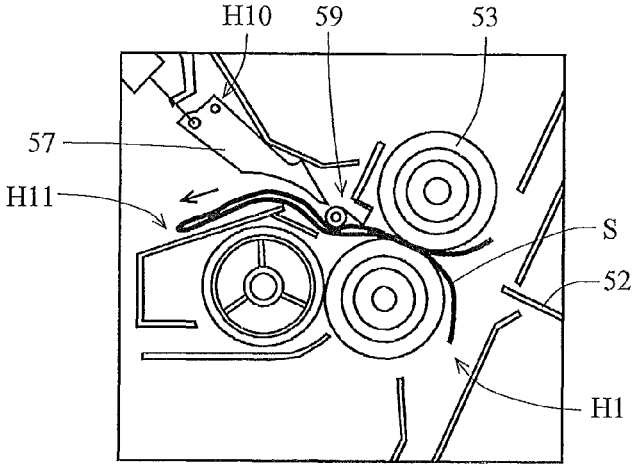

The folding processing performed by the folding processing portion 50 conFIGured as described above will now be described. FIG. 4 shows a process diagram illustrating how the sheet S is folded double. When a predetermined number of sheets S are placed in position by the first stopper 51 C (shown in FIG. 2) and are collected in the transport path H1, the first roller 53 and the second roller 54 are rotated, and the sheet folding plate 52 protrudes toward the nip portion between the first roller 53 and the second roller 54 (FIG. 4A). Thus, the predetermined position of the sheet S is pushed into the nip portion between the first roller 53 and the second roller 54 and is sandwiched and transported by the first roller 53 and the second roller 54, with the result that the first crease is formed in the sheet S (FIG. 4B). When the sheet S is sandwiched between the first roller 53 and the second roller 54, the sheet folding plate 52 is moved in the opposite direction and is retracted from the transport path H1. Then, the transport path switch means 57 is placed in such a position that it swings counterclockwise to prevent the sheet S from entering the transport path H10 and guides the sheet S to the transport path H11. In this way, the sheet S is guided to the transport path H11 (FIG. 4C).

Figure 5A:
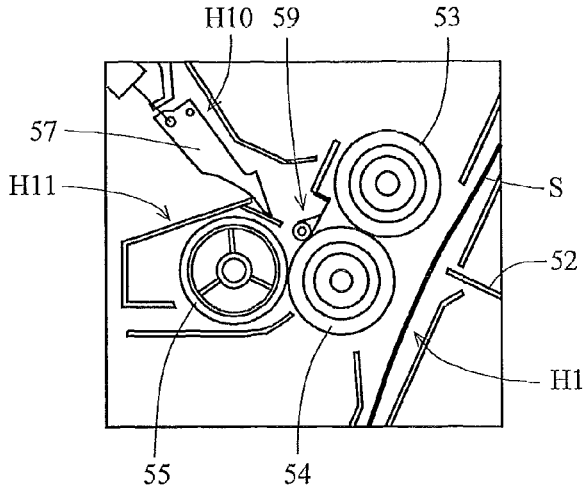
[FIG. 5] A process diagram of how the sheet is folded in three.
Figure 5B:
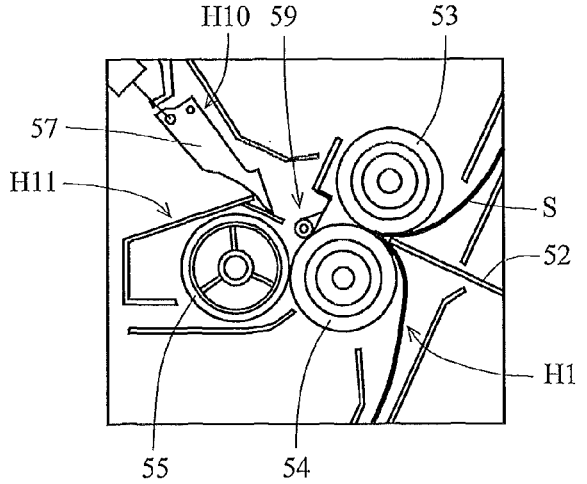

FIGS. 5 and 6 show process diagrams illustrating how the sheet is folded in three. As in the processing for folding the sheet double, when a predetermined number of sheets S are placed in position by the first stopper 51C (shown in FIG. 2) and are collected in the transport path H1, the first roller 53 and the second roller 54 are rotated, and the sheet folding plate 52 protrudes toward the nip portion between the first roller 53 and the second roller 54 (FIG. 5A). Thus, the predetermined position of the sheet S is pushed into the nip portion between the first roller 53 and the second roller 54 and is sandwiched and transported by the first roller 53 and the second roller 54, with the result that the first crease is formed in the sheet S (FIG. 5B).

Figure 5C:
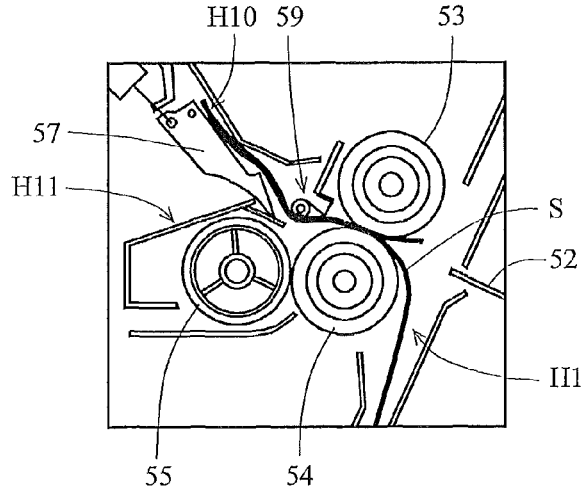

Since the transport path switch means 57 is placed in such a position as to allow the sheet S to enter the transport path H10 and prevent the sheet S from entering the transport path H11, the sheet S is transported to the transport path H10 (FIG. 5C). The sheet pressing means 59 is swung up on the point 594 (shown in FIG. 3) in the sheet transport direction by the sheet S that is moved.

Figure 6D:
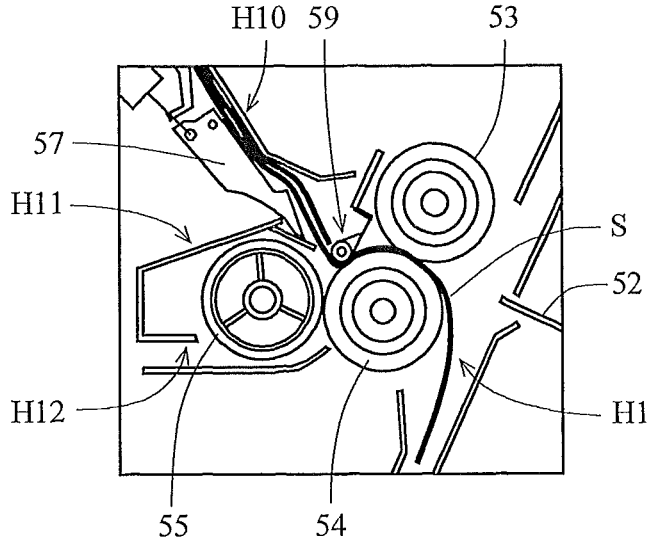
[FIG. 6] A process diagram when the sheet is folded in three.

Then, the first crease is pressed against the second stopper 581 (shown in FIG. 2). On the other hand, since the first roller 53 and the second roller 54 are continuously rotated, a bend is formed in the sheet S (FIG. 6D). Here, the transport path H10 is arranged obliquely upward as seen from the nip portion between the first roller 53 and the second roller 54. Specifically, since the transport path H10 is formed to intersect the straight line perpendicular to the straight light intersecting the rotation centers of the first roller 53 and the second roller 54, the sheet S is more likely to be bent such that it is convex downward. However, conventionally, the sheet S may be bent to be convex upward due to the curling of the sheet S or the like, and the sheet S may fail to be bent evenly in the direction of the width of the sheet S. Consequently, failures such as the jamming of the sheet S, a transport failure and the formation of a crease in an undesired position may be encountered.

For above reason, in the present invention, the sheet pressing means 59 further applies such a force that the sheet S is bent to be convex downward, and thus the conventional failures are avoided and the second crease is reliably formed in the desired position. Although, in the present embodiment, the weight of the bar-shaped member 592 itself in the sheet pressing means 59 and the restoring force of the sheet member 591 produce the force that allows the sheet S to be bent to be convex downward, force application means may be provided in the sheet pressing means 59 such that the force described above is further increased. As a force produced by the force application means, it is preferable to use such a force that, when the sheet S is transported by the first roller 53 and the second roller 54, the sheet pressing means 59 is swung up in the transport direction by the transported sheet S.

When the sheet S is folded inwardly in three, the first crease in the sheet S is pressed against the second stopper 581, and thereafter the leading edge portion of the sheet that is folded along the first crease is prevented from being opened as a result of the end portion being pressed by the sheet pressing means 59. Consequently, the folding of the corner of the sheet and the crinkling of the sheet are effectively prevented.

Since, in the present invention, the sheet pressing means 59 is conFIGured such that the bar-shaped member 592 is supported by the sheet member 591, even if a strong force is applied to the sheet pressing means 59 at the time of processing for handing a paper jam or the like, the sheet pressing means 59 is unlikely to be deformed, and it is possible to stably perform the folding processing for a long period of time. When the bar-shaped member 592 is supported by the sheet member 591, for example, one side of the sheet member 591 may be attached to the base member 593 and the opposite side may be attached to the bar-shaped member 592.

Figure 6E:
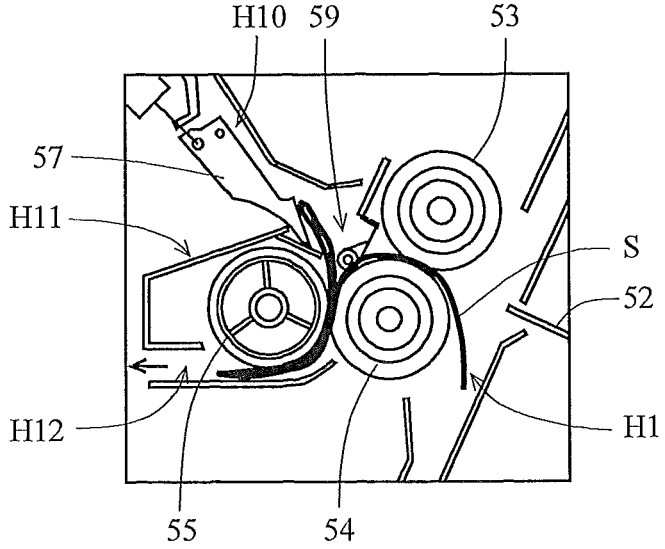

Then, the sheet S bent to be convex downward enters the nip portion between the second roller 54 and the third roller 55, and is sandwiched and transported by these rollers, with the result that the second crease is formed in the sheet S (FIG. 6E). The sheet S in which two creases are formed by the rotation of the second roller 54 and the third roller 55 is transported to a transport path H12.

Although, in the present embodiment described above, the sheet S is pushed into the nip portion between the first roller 53 and the second roller 54 by the sheet folding plate 52, and thus the first crease is formed in the sheet S, a bend may be formed by transporting the sheet S toward the first stopper 51C even after the leading edge of the sheet S is pressed against the first stopper 51C, and the formed bend may be guided into the nip portion between the first roller 53 and the second roller 54.

What is claimed is:

1. A sheet folding device including:

a first folding roller pair that forms a first crease in a sheet;

a second folding roller pair that forms a second crease in the sheet;

a first stopper member that a leading edge of the sheet transported in a transport direction is pressed against and that places the sheet into position; and a second stopper member that the first crease in the sheet is pressed against and that places the sheet into position, in which the leading edge of the sheet in the transport direction is pressed against the first stopper member such that a position where the first crease in the sheet is to be formed is determined, the position where the first crease is to be formed is guided into a nip portion of the first folding roller pair such that the first crease is formed in the sheet, then the first crease in the sheet is pressed against the second stopper member such that a bend is formed in the sheet and the formed bend is guided into a nip portion of the second folding roller pair such that the second crease is formed in the sheet, the sheet folding device further comprising:

a sheet pressing unit that assists the formation of the bend in the sheet and that guides the bend into the nip portion of the second folding roller pair, wherein the sheet pressing unit includes a pressing member whose weight assists the formation of the bend in the sheet and a flexible support member that swingably supports the pressing member, and wherein the support member comprises a cylindrical sleeve.

2. The sheet folding device of claim 1, wherein at least a part of the pressing member is rigid and/or elastic.

3. A sheet post-processing device comprising the sheet folding device of claim 2.

4. The sheet folding device of claim 1, wherein the pressing member comprises a bar-shaped member, and the sheet pressing unit is comprised of the bar-shaped member inserted into the cylindrical sleeve, the circumferential length of the bar-shaped member being less than a circumferential length of the cylindrical sleeve.

5. A sheet post-processing device comprising the sheet folding device of claim 4.

6. The sheet folding device of claim 1, wherein the first folding roller pair is formed with a first roller and a second roller, and the second folding roller pair is formed with the second roller and a third roller.

7. A sheet post-processing device comprising the sheet folding device of claim 6.

8. The sheet folding device of claim 1, further comprising:

a sheet folding unit that pushes out the position where the first crease is to be formed from a side of a surface of the sheet opposite a surface with respect to the first folding roller pair toward the nip portion of the first folding roller.

9. A sheet post-processing device comprising the sheet folding device of claim 8.

10. The sheet folding device of claim 1, wherein, when the sheet does not pass the sheet pressing unit, a free end of the sheet pressing unit is arranged on a side of the nip portion of the second folding roller pair to be on a common tangent of the second folding roller pair on an upstream side in the transport direction.

11. A sheet post-processing device comprising the sheet folding device of claim 10.

12. A sheet post-processing device comprising the sheet folding device of claim 1.

13. A sheet folding device including:

a first folding roller pair that forms a first crease in a sheet;

a second folding roller pair that forms a second crease in the sheet;

a first stopper member that a leading edge of the sheet transported in a transport direction is pressed against and that places the sheet into position; and a second stopper member that the first crease in the sheet is pressed against and that places the sheet into position, in which the leading edge of the sheet in the transport direction is pressed against the first stopper member such that a position where the first crease in the sheet is to be formed is determined, the position where the first crease is to be formed is guided into a nip portion of the first folding roller pair such that the first crease is formed in the sheet, then the first crease in the sheet is pressed against the second stopper member such that a bend is formed in the sheet and the formed bend is guided into a nip portion of the second folding roller pair such that the second crease is formed in the sheet, the sheet folding device further comprising:

a sheet pressing unit that assists the formation of the bend in the sheet and that guides the bend into the nip portion of the second folding roller pair, wherein the sheet pressing unit includes a pressing member whose weight assists the formation of the bend in the sheet and a flexible support member that swingably supports the pressing member, and wherein the pressing member is arranged inside the support member.

14. A sheet post-processing device comprising the sheet folding device of claim 13.

15. A sheet folding device including:

a first folding roller pair that forms a first crease in a sheet;

a second folding roller pair that forms a second crease in the sheet;

a first stopper member that a leading edge of the sheet transported in a transport direction is pressed against and that places the sheet into position; and a second stopper member that the first crease in the sheet is pressed against and that places the sheet into position, in which the leading edge of the sheet in the transport direction is pressed against the first stopper member such that a position where the first crease in the sheet is to be formed is determined, the position where the first crease is to be formed is guided into a nip portion of the first folding roller pair such that the first crease is formed in the sheet, then the first crease in the sheet is pressed against the second stopper member such that a bend is formed in the sheet and the formed bend is guided into a nip portion of the second folding roller pair such that the second crease is formed in the sheet, the sheet folding device further comprising:

a sheet pressing unit that assists the formation of the bend in the sheet and that guides the bend into the nip portion of the second folding roller pair, wherein the sheet pressing unit includes a pressing member whose weight assists the formation of the bend in the sheet and a flexible support member that is swingable and that swingably supports the pressing member, and wherein the support member is connected to a pivot member.

16. A sheet post-processing device comprising the sheet folding device of claim 15.

17. A sheet folding device, including:

a first folding roller pair that forms a first crease in a sheet;

a second folding roller pair that forms a second crease in the sheet;

a first stopper member that a leading edge of the sheet transported in a transport direction is pressed against and that places the sheet into position; and a second stopper member that the first crease in the sheet is pressed against and that places the sheet into position, in which the leading edge of the sheet in the transport direction is pressed against the first stopper member such that a position where the first crease in the sheet is to be formed is determined, the position where the first crease is to be formed is guided into a nip portion of the first folding roller pair such that the first crease is formed in the sheet, then the first crease in the sheet is pressed against the second stopper member such that a bend is formed in the sheet and the formed bend is guided into a nip portion of the second folding roller pair such that the second crease is formed in the sheet, the sheet folding device further comprising:

a sheet pressing unit that assists the formation of the bend in the sheet and that guides the bend into the nip portion of the second folding roller pair, wherein the sheet pressing unit includes a pressing member whose weight assists the formation of the bend in the sheet and a flexible support member that is swingable and that swingably supports the pressing member, and wherein the pressing member has a cylindrical shape.

18. A sheet post-processing device comprising the sheet folding device of claim 17.

* * * * *